US011676564B2

(12) United States Patent
Simon

(10) Patent No.: US 11,676,564 B2
(45) **Date of Patent: *Jun. 13, 2023**

(54) INTEGRATED MELODIC INSTRUMENT DIGITAL INTERFACE (MIDI) CONTROLLER WITHIN A LAPTOP CHASSIS

(71) Applicant: Jared Sidney Simon, Montebello, NY (US)

(72) Inventor: Jared Sidney Simon, Montebello, NY (US)

( * ) Notice: Subject to any disclaimer, the term of this patent is extended or adjusted under 35 U.S.C. 154(b) by 112 days.

This patent is subject to a terminal disclaimer.

(21) Appl. No.: 17/206,699

(22) Filed: Mar. 19, 2021

(65) Prior Publication Data

US 2021/0210058 A1 Jul. 8, 2021

Related U.S. Application Data

(63) Continuation of application No. 16/775,197, filed on Jan. 28, 2020, now Pat. No. 10,984,770.

(60) Provisional application No. 62/858,203, filed on Jun. 6, 2019.

(51) Int. Cl.
*G10H 1/00* (2006.01)
*G10H 1/34* (2006.01)

(52) U.S. Cl.
CPC ..... *G10H 1/0066* (2013.01); *G10H 1/0008* (2013.01); *G10H 1/344* (2013.01); *G10H 2220/221* (2013.01)

(58) Field of Classification Search
CPC .... G10H 1/0066; G10H 1/344; G10H 1/0008; G10H 2220/221
See application file for complete search history.

(56) References Cited

U.S. PATENT DOCUMENTS

| | | | |
|---|---|---|---|
| 5,088,378 | A | 2/1992 | DeLaTorre |
| 6,351,225 | B1 | 2/2002 | Moreno |
| 6,842,168 | B1 | 1/2005 | Sim |
| 7,247,788 | B2 | 7/2007 | Lai |
| 8,354,580 | B2 | 1/2013 | Bowen |
| 9,053,688 | B2 | 6/2015 | Yoshikawa |
| 9,304,551 | B1 | 4/2016 | Peirce |
| 9,967,044 | B1 | 5/2018 | Gray |
| 10,269,335 | B1 | 4/2019 | O'Hair |
| 10,754,390 | B2 | 8/2020 | Quinn |
| 2002/0144586 | A1 | 10/2002 | Harry, Jr. |
| 2004/0173085 | A1 | 9/2004 | Seow |
| 2004/0206226 | A1 | 10/2004 | Negoescu |
| 2004/0231500 | A1 | 11/2004 | Sim |
| 2004/0231501 | A1 | 11/2004 | Sim |
| 2005/0087061 | A1 | 4/2005 | Sim |
| 2006/0117939 | A1 | 6/2006 | Lai |
| 2007/0137467 | A1 | 6/2007 | Sim |
| 2007/0175316 | A1 | 8/2007 | Kumarova |

(Continued)

*Primary Examiner* — Jeffrey Donels

(57) ABSTRACT

A system and method for a laptop computer chassis that integrates a MIDI controller. The laptop is specifically designed for music producers, and it combines a standard laptop computer with producer hardware into one design. The laptop computer features a standard keyboard and buttons, but replaces the lower portion with a MIDI controller. The system functions together through the use of a DAW, but will also be compatible with other 3$^{rd}$ party products.

13 Claims, 4 Drawing Sheets

(56) References Cited

U.S. PATENT DOCUMENTS

| | | | | |
|---|---|---|---|---|
| 2009/0114078 | A1 | 5/2009 | Plamondon | |
| 2013/0068085 | A1 | 3/2013 | Yoshikawa | |
| 2015/0047494 | A1* | 2/2015 | Cronin | G10H 1/0008 84/609 |
| 2019/0041919 | A1 | 2/2019 | Makinen | |
| 2021/0042006 | A1* | 2/2021 | McMillen | G06F 1/16 |

* cited by examiner

INTEGRATED MELODIC INSTRUMENT DIGITAL INTERFACE (MIDI) CONTROLLER WITHIN A LAPTOP CHASSIS

CROSS-REFERENCE TO RELATED APPLICATION

This application claims benefit under 35 U.S.C. 120 from U.S. Non-provisional application Ser. No. 16/775,197, filed Jan. 20, 2020, which is hereby incorporated by reference.

FIELD OF THE INVENTION

The present invention generally relates to systems and methods for computer equipment geared toward music production, and, in particular, this is a laptop computer chassis with an integrated Musical Instrument Digital Interface (MIDI) Controller.

Musicians today can produce the sound of almost any instrument imaginable through the use of a standard computer, a Digital Audio Workstation (DAW), and a Melodic Instrument Digital Interface (MIDI) Controller. A DAW is an electronic device or application software used for recording, editing and producing audio files. DAWs come in a wide variety of configurations from a single software program on a laptop, to an integrated stand-alone unit, all the way to a highly complex configuration of numerous components controlled by a central computer. A MIDI controller is any hardware or software that generates and transmits MIDI data to MIDI-enabled devices, typically to trigger sounds and control parameters of an electronic music performance, based on a producer's selected preferences.

BACKGROUND OF THE INVENTION

Musicians today can produce the sound of almost any instrument imaginable through the use of a standard computer, a Digital Audio Workstation (DAW), and a Melodic Instrument Digital Interface (MIDI) Controller. A DAW is an electronic device or application software used for recording, editing and producing audio files. DAWs come in a wide variety of configurations from a single software program on a laptop, to an integrated stand-alone unit, all the way to a highly complex configuration of numerous components controlled by a central computer. A MIDI controller is any hardware or software that generates and transmits MIDI data to MIDI-enabled devices, typically to trigger sounds and control parameters of an electronic music performance, based on a producer's selected preferences.

With just these three (3) individual components, melodic and harmonic riffs can be created almost anywhere within seconds. Additionally, aspiring musicians may in fact require a computer if they wish to make use of the numerously available brands of keyboard tutorial software programs.

However, not all musicians will know where to start. To create music on a professional level, artists need to gather a lot of equipment and consider their computing power. Additionally, to make use of these components, sufficient space on a desk, table counter or other horizontal surface must be secured. Accordingly, there exists a need for a means by which the functionality and performance of a computer laptop and music production equipment can be enjoyed, but without sacrificing portability or a significant amount of space.

The development of the present invention fulfills this need, as it combines the necessities of music production into a single device. Therefore, the invention falls into both the record production industry and electronic computer manufacturing industry.

The record production industry is comprised of master recording (leasing and licensing), non-independent record producers, and record production without duplication or distribution, and the electronic computer manufacturing industry is comprised of analog, digital, hand-held (e.g. PDAs), hybrid, laptop, mainframe, notebook, personal, portable and workstations computer manufacturing, computer servers manufacturing, and microcomputers and minicomputers manufacturing.

SUMMARY OF THE INVENTION

The invention comprises of a laptop computer casing having a hollow structure, further comprising data storage and processing components with input/output registers. The registers are disposed within the casing to process incoming data and store the processed data for later use. There is a computer keyboard with a track point, along with dedicated left-click and right-click mouse buttons directly below said keyboard, disposed on a surface of the casing and placed into electrical communication with the input/output registers with the data storage and processing components. On the top portion of the invention, ten (10), or other configurable number, channel buttons can be seen above the computer keyboard. These functions allow for effects set by the producer to be activated on specific sounds, based on the channel, or group of sounds within a DAW, being used. There is a MIDI Controller attached to the bottom portion of the casing, which contains programmable producer functions, and it includes, but is not limited to, octave control, pitch bending, modulation and sustain on the left side, a 25-key piano keyboard is located in the center, and eight (8), or other configurable number, drum pads are located on the right side, which is all in electrical communication with the input/output registers and the data storage and processing components.

A display is configured to receive said processed data and display the same. The processed data is at least one coalesced image having a shell and comprising a shell, an image display unit and display control registers. There is a hinged connection to rotatingly connect the casing to the display, and the MIDI Controller and the computer keyboard are configured to provide the incoming data as inputted therein.

The portable computing device further comprises at least one (1) added peripheral selected from the group consisting of: a USB-A port, a USB Type C Port, an HDMI connection, a BLUETOOTH® connection, an Ethernet connection, a Wi-Fi connection, an AUX port, an SD Card slot, and at least one speaker. Each added peripheral is in electronic communication with the data storage and processing components with the input/output registers. The device is configured to receive a sound card and has a power switch and rechargeable battery. The hinged connection is provided with a stop tension mechanism.

Currently, there is no single product available on the market that provides a simple, all-in-one solution for producers. Furthermore, there is no laptop computer specifically marketed towards musicians, as all current products revolve around the workstation and/or gaming use. The company's competitors include all companies that produce laptop computers and/or MIDI controllers. Compared to the current competition, this product allows for additional portability and is styled like most workstation laptops. It allies directly with the owners of producer's DAW and is compatible with 3rd party products that connect to a Windows laptop.

BRIEF DESCRIPTION OF THE DRAWINGS

For the purposes of illustrating the present invention, there is shown in the drawings a form which is presently preferred, it being understood however, that the invention is not limited to the precise form shown by the drawing in which.

DESCRIPTIVE KEY

Figure 3:
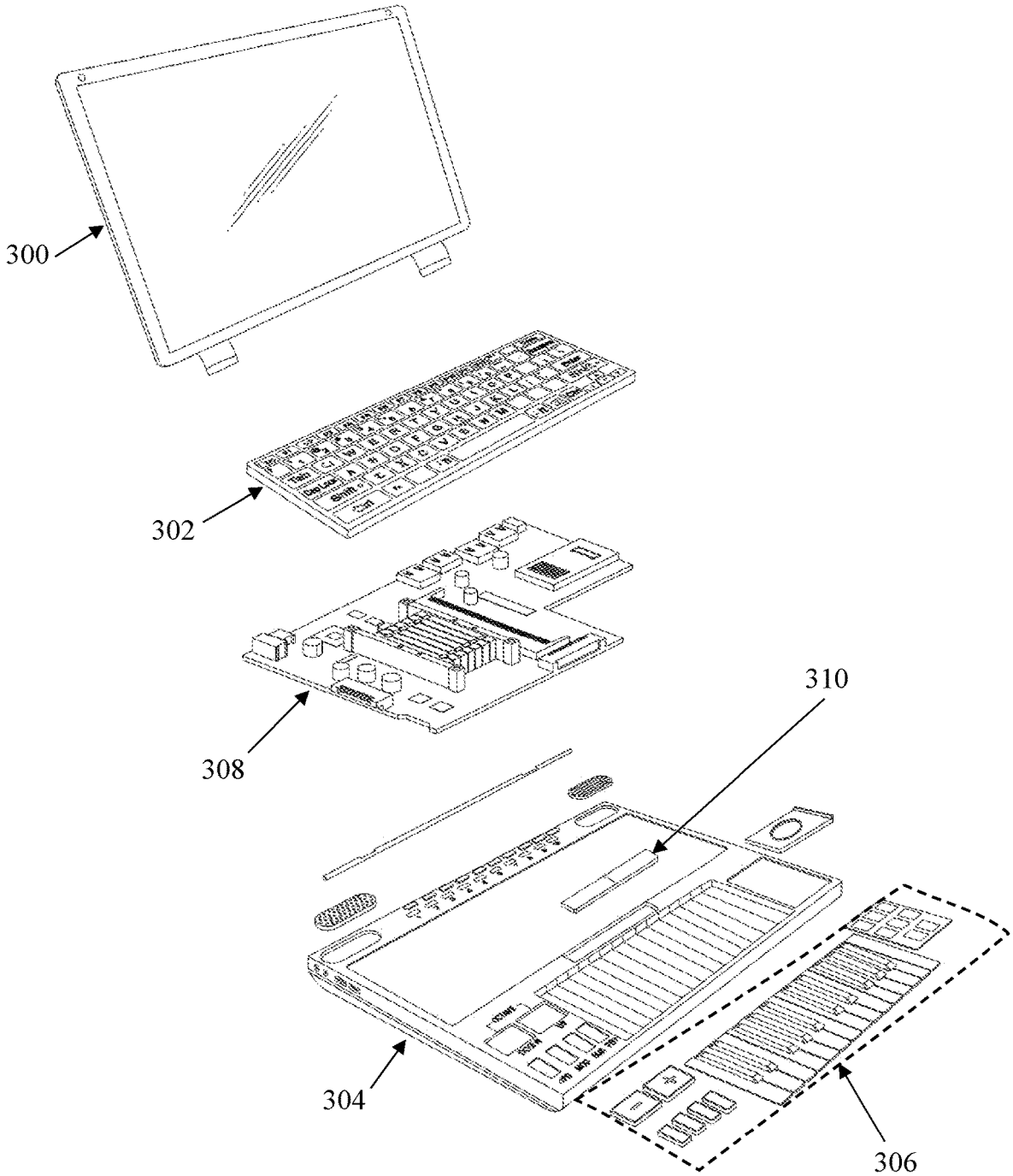
FIG. 3 is an exploded view of the invention in accordance with an embodiment of the present invention; and, FIG. 4 illustrates an isolated section view of the drum pads' module in accordance with an embodiment of the present invention.
Figure 4:
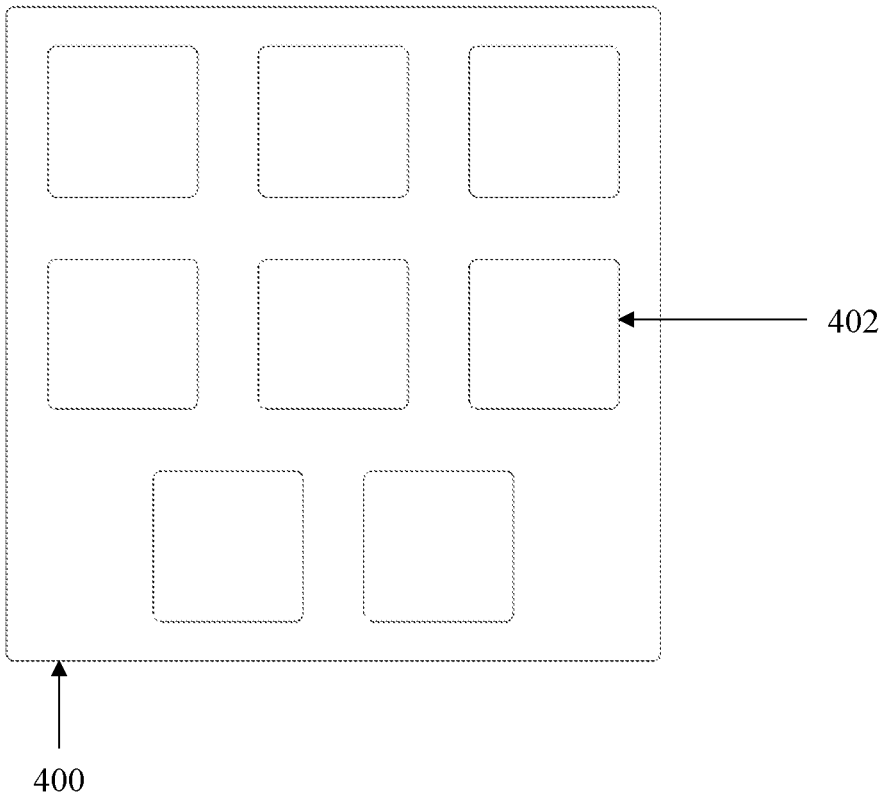

100 Bottom Portion of Laptop (FIG. 1)
200 Top Portion of Laptop (FIG. 2)
202 Laptop Screen (FIG. 2)
204 Laptop Keyboard (FIG. 2)
206 Bottom Portion of Laptop (FIG. 2)
208 Piano Keyboard (FIG. 2)
210 Producer-Functional Buttons (FIG. 2)
212 Drum Pad Buttons (FIG. 2)
214 Effects Channel Buttons (FIG. 2)
216 Mouse Click Buttons (FIG. 2)
300 Laptop Screen (FIG. 3)
302 Laptop Keyboard (FIG. 3)
304 Laptop Chassis (FIG. 3)
306 MIDI Controller Keyboard and Buttons (FIG. 3)
308 Custom Laptop Motherboard (FIG. 3)
310 Mouse Click Buttons (FIG. 3)
400 Drum Pad Module (FIG. 4)
402 Singular Drum Pad (FIG. 4)

DETAILED DESCRIPTION OF THE INVENTION

The invention is presented in terms of its preferred embodiment, herein depicted within FIGS. 1 through 4. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Figure 1:
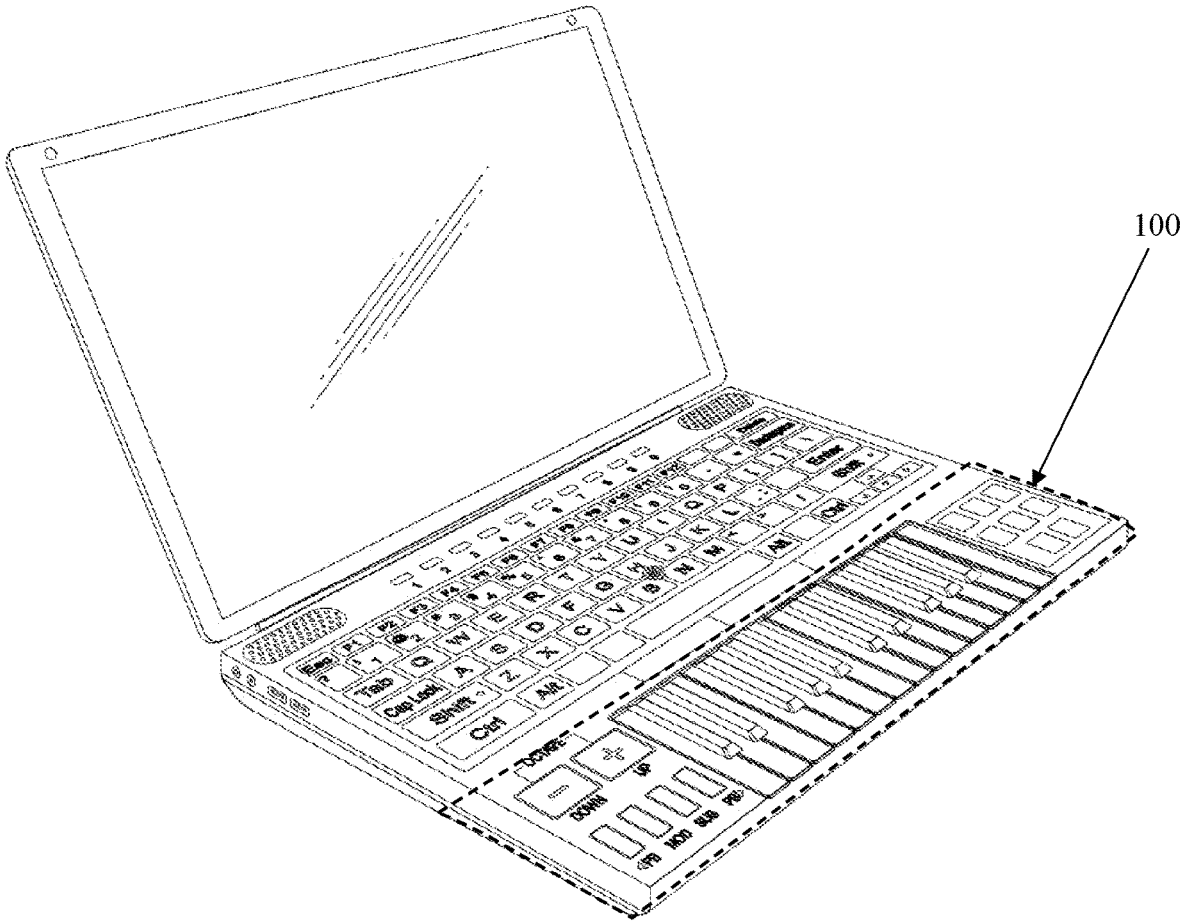
FIG. 1 depicts an isometric view of the invention in accordance with an embodiment of the present invention.

FIG. 1 depicts an isometric view of the invention in accordance with an embodiment of the present invention. This depiction is provided to show the body of the invention. More details and an explanation can be found in FIGS. 2 and 3. The invention is a standard laptop computer with a modified chassis, where the bottom portion (100) of the laptop computer features an integrated MIDI controller which is connected to the laptop through electronics. The laptop uses specialized, but commercially available software, known as Digital Audio Workstation (DAW) software, that recognizes its integration in the operating system, which is placed into electrical communication with said input/output registers with said data storage and processing components.

Figure 2:
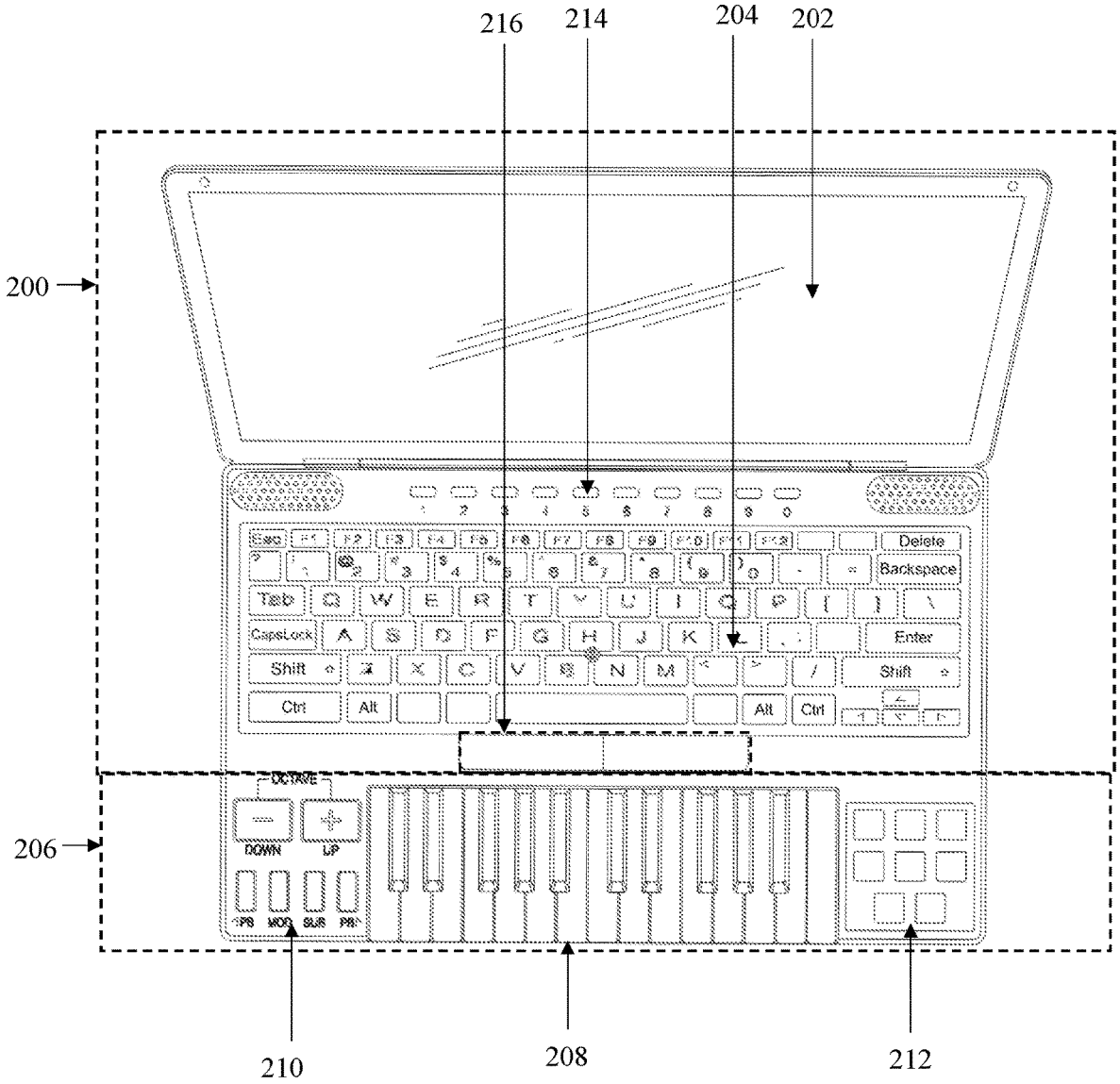
FIG. 2 illustrates a top view of the invention in accordance with an embodiment of the present invention.

FIG. 2 illustrates a top view of the invention in accordance with an embodiment of the present invention. This depiction provides a detailed look at the main physical features of the laptop computer. The top portion (200) of the laptop features a screen (202), standard keyboard with a track point (204), two mouse buttons with left-click and right-click features (216), and any other features that may be found on a standard laptop computer. The bottom portion (206) of the laptop features the MIDI Controller integration. This involves a custom-made chassis that supports the specific arrangement of buttons and keys when manufactured. In this depiction, the laptop's main feature is the piano keyboard (208). A 25-key piano keyboard is directly built into the chassis that completely replaces a laptop computer's touchpad. These piano keys can be velocity-sensitive, meaning that the harder a key is pressed, the louder the sound will be from the laptop's speakers. This function works based on the amount of pressure placed on the button. The number of keys and velocity sensitivity may change based on a producer's or manufacturer's preferences. To the left of the piano keyboard, there are producer-functional buttons (210). In this particular design, the – and + buttons decrease and increase the octaves respectively, and the four (4) smaller buttons represent (from left to right) pitch-bend down, modulation, sustain, and pitch-bend up functions within a DAW. The buttons may also host lighting if desired by the manufacturer, although they are not limited to only performing the tasks mentioned; they can be programmed by a manufacturer to serve other uses, which include, but are not limited to transposing musical notes, amplifying decibels of audio, increasing/decreasing tempo of audio, etc. To the right of the piano keyboard are some drum pad buttons (212). These are configurable buttons that can load any set of sounds configured by a user/producer within a DAW. If a user assigns "Sound X" to any particular button within the respective program, "Sound X" will play if he/she presses the respective button on this pad. These buttons can also light up and be velocity sensitive if desired by a manufacturer. These buttons may serve other functions as well, depending on a user's specific configuration. There is also a set of channel buttons (214) above the computer keyboard. An effect preset can be assigned to any of these buttons, depending on the user's configuration within a DAW. For example, a flanger effect can be assigned to Button 1 when Channel #1 is highlighted. If the button presents an active signal through any means decided by the manufacturer, that means the effect is active. If there is more than one instrument belonging to this same channel, the effect will also apply to the other instruments. When a producer selects a different channel, the effect will be automatically turned off unless it is activated once more by the user. All of these functions provided by the integrated MIDI Controller are placed into electrical communication with said input/output registers with said data storage and processing components.

FIG. 3 is an exploded view of the invention in accordance with an embodiment of the present invention. The exploded view shows the basic parts of the laptop computer, if looked at the most fundamental level. The main standard laptop computer parts consist of a screen (300), a keyboard with a track point (302), and two mouse buttons with left-click and right-click features (310). The invention's parts feature a custom shaped bottom chassis (304) with piano keyboard and buttons relating to the MIDI Controller (306). The chassis is seen in this figure with a cut out section for all the aforementioned functions and piano keyboard not seen on standard laptop computers. This section may be modeled based on manufacturer preference. The piano keyboard and buttons are wired into the motherboard (308) or integrated directly into it. The laptop computer is running on an existing operating system with software and hardware integration though current manufacturing methods. The operating system recognizes different inputs from buttons, keys, keyboard, power button through standard component connections in the electronics.

FIG. 4 illustrates an isolated section view of the drum pads' module in accordance with an embodiment of the present invention. The isolated section view separates the drum pad module (400) from the rest of the invention, as it hosts custom programmable features that is determined by both the manufacturer and the user. This module hosts eight (8), or other configurable number, singular drum pads (402) that serve as the means of completing a desired function set by the manufacturer or producer. Each singular pad and the whole module is placed into electrical communication with said input/output registers with said data storage and processing components.

Although the present invention has been described in relation to particular embodiments thereof, many other variations and other uses will be apparent to those skilled in the art. It is preferred, therefore, that the present invention be limited not by the specific disclosure herein, but only by the gist and scope of the disclosure.

What is claimed is:

1. A portable computing device, comprising:

a casing having a hollow structure;

data storage and processing components with input/output registers disposed within said casing to process incoming data and store said processed data for later use;

a computer keyboard disposed on a surface of said casing and placed into electrical communication with said input/output registers with said data storage and processing components;

a tracking device disposed on said keyboard;

a display configured to receive said processed data and display said processed data as at least one coalesced image;

a hinged connection rotatingly connecting said casing and said display;

a MIDI Controller in electrical communication with said input/output registers with said data storage and processing components;

a plurality of keys capable of producer-defined functions;

a plurality of channel effects keys disposed on the casing that is in electrical communication with said input/output registers with said data storage and processing components.

2. The device recited in claim 1, further comprising at least one added peripheral selected from the group consisting of: a USB-A port, a USB Type C Port, an HDMI connection, a BLUETOOTH® connection, an Ethernet connection, a Wi-Fi connection, an AUX port, an SD Card slot, and at least one speaker;

wherein each added peripheral is in electronic communication with said data storage and processing components with said input/output registers.

3. The device recited in claim 1, wherein said device is configured to receive a sound card.

4. The device recited in claim 1, further comprising a power switch and rechargeable battery.

5. The device recited in claim 1, wherein said hinged connection is provided with a stop tension mechanism.

6. The device recited in claim 1, wherein said hinged connection is provided with electrical connectors.

7. The device recited in claim 1, further comprising a plurality of buttons capable of manufacturer-defined functions.

8. The device recited in claim 7, wherein the plurality of buttons capable of manufacturer-defined functions is six.

9. The device recited in claim 7, wherein the plurality of buttons capable of manufacturer-defined and producer-defined functions is six.

10. The device recited in claim 1, wherein the plurality of buttons capable of producer-defined functions is six.

11. The device recited in claim 1, wherein the plurality of channel effects buttons is ten.

12. The device recited in claim 1, wherein the plurality of keys is twenty-five.

13. The device recited in claim 1, further comprising a plurality of drum pads.

* * * * *